United States Patent [19]

Cutler

[11] Patent Number: 4,491,850

[45] Date of Patent: Jan. 1, 1985

[54] ANTENNA FORMED OF SERIES OF METALLIC AND NON-METALLIC CONDUCTIVE SECTIONS

[76] Inventor: David Cutler, 660 Camellia Ct., Plantation, Fla. 33317

[21] Appl. No.: 284,635

[22] Filed: Jul. 20, 1981

[51] Int. Cl.[3] ..... H01Q 9/30

[52] U.S. Cl. ..... 343/900; 343/908

[58] Field of Search ..... 343/715, 873, 900, 908

[56] References Cited

U.S. PATENT DOCUMENTS

| | | | |
|---|---|---|---|
| 3,128,467 | 4/1964 | Lanctot | 343/785 |
| 4,008,477 | 2/1977 | Babij et al. | 343/873 |
| 4,134,120 | 1/1979 | De Loach et al. | 343/900 |
| 4,246,217 | 1/1981 | Hottel et al. | 343/715 |
| 4,246,586 | 1/1981 | Henderson et al. | 343/873 |

*Primary Examiner*—Eli Lieberman

*Attorney, Agent, or Firm*—Eugene F. Malin

[57] ABSTRACT

A new and improved antenna having a body portion which is either constructed from a substantially non-metallic conductor such as carbon or graphite and the like to provide bandwidths, within tolerable standing wave ratios, much wider than is presently obtainable utilizing conventional antennas. Selected areas of the non-metallic conductive body portion may also be coated with a metallic conductor to vary the bandwidth and standing wave ratios as required. In another embodiment, a non-conductive body portion may be coated with both a metallic conductor coating and a non-metallic conductor coating in various relationships to vary the bandwidth and standing wave ratio. Antennas constructed primarily of non-metallic conductors such as carbon or graphite are conducive to use in high temperature applications because only slight changes occur in the antennas operating characteristics over large changes in temperature.

4 Claims, 11 Drawing Figures

PRIOR ART

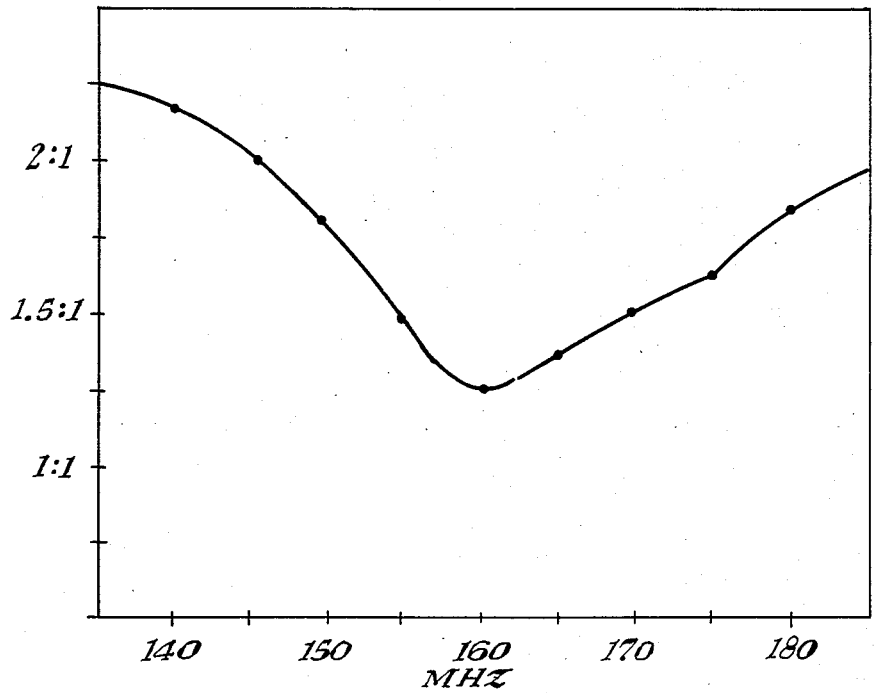
Fig.5A.
Fig. 5.
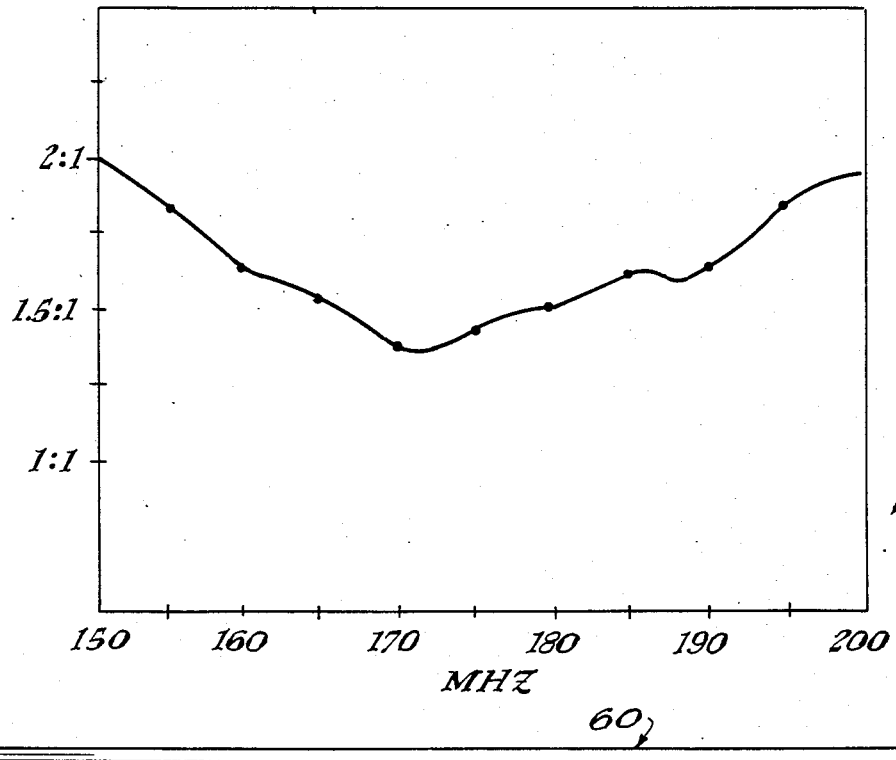
Fig.6A.
Fig.6.

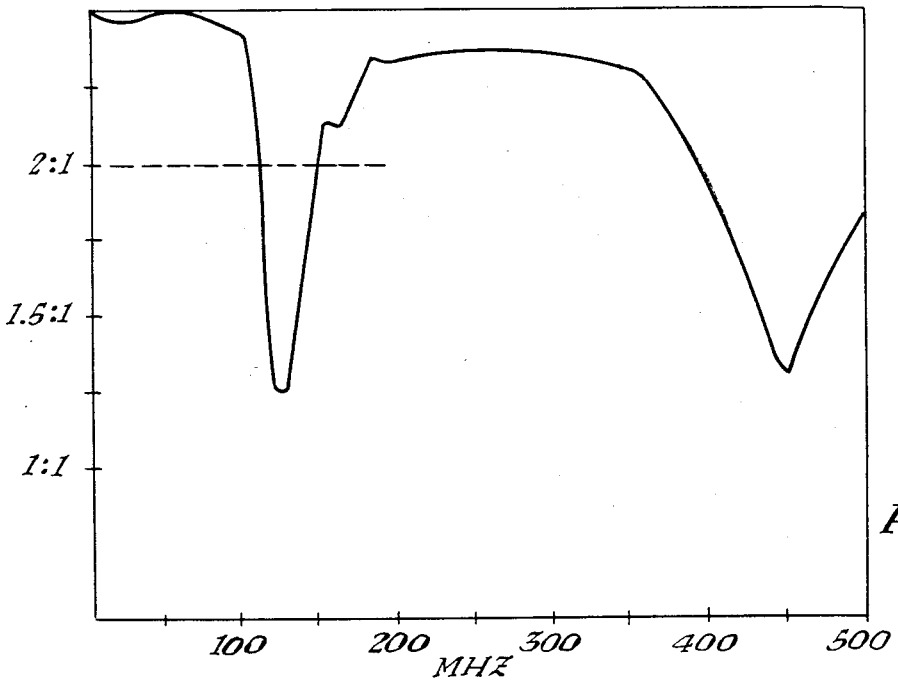
Fig.7A.
Fig.7.
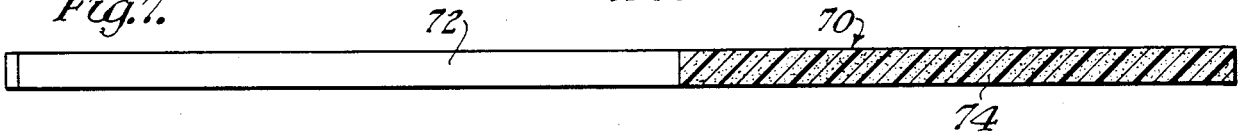
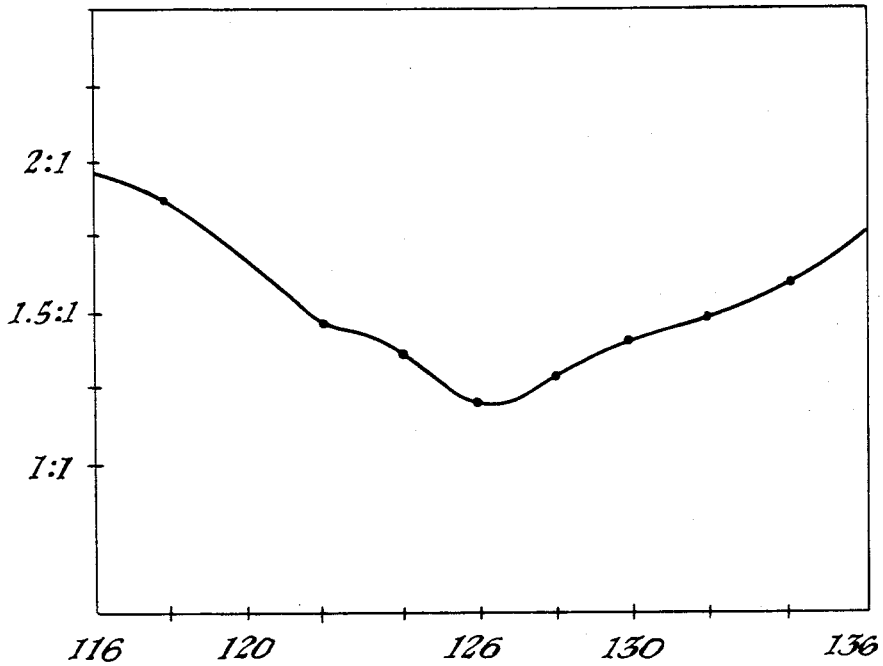
Fig. 8.

ANTENNA FORMED OF SERIES OF METALLIC AND NON-METALLIC CONDUCTIVE SECTIONS

BACKGROUND OF THE INVENTION

The present invention relates to antennas and more particularly to non-metallic conductive antennas and antennas constructed of both non-metallic conductive materials and metallic conductive materials.

In the past, the band width of metallic conductor antennas has been restricted due to the increase in standing wave ratio over the operating frequencies of the antenna. This occurs as a practical matter because the change in antenna frequency is reflected as a change in the standing wave ratio on the transmission line. This would not occur if the antenna impedance were purely resistant and constant regardless of frequency. The principal cause of the change in the standing wave ratio is the change in the reactive components of the antenna impedence when the frequency is varied. If the reactance changes rapidly with frequency the standing wave ratio will rise rapidly off the center frequency, but if the rate of reactance change is small the shift in standing wave ratio likewise will be small.

The present invention takes advantage of this electrical principal by using a non-metallic conductor such as carbon or graphite as the primary component of the antenna to minimize the reactive components of the antenna over a large band width therefore the standing wave ratio stays low over a very large band width.

Since carbon, graphite, and other non-metallic conductors can withstand high temperatures without a large change in conductive characteristics, the antenna constructed of such material would be conducive for use in space vehicles, especially during re-entry into the earth's atmosphere, when high temperatures are generated.

SUMMARY OF THE INVENTION

According to the present invention, a new and improved antenna is presented. By using a non-metallic conductor such as carbon or graphite and the like a very wide band width which maintains tolerable standing wave ratios normally in the order of 2:1 or below over the entire band width is provided. The length, width and thickness of the antenna may be varied to provide required frequency characteristics.

In the preferred embodiment the antenna is constructed of carbon reinforced nylon or graphite reinforced nylon.

In another embodiment, the antenna may be constructed of a body portion made from a mixture of epoxy, carbon and any conductive metal such as nickel, copper, zinc; the body portion being coated with a strong, non-conductive material such as plastic or ceramic.

In yet another embodiment, the antenna comprises a non-conductive body portion with a plurality of non-metallic conductor coatings and a plurality of metallic conductive coatings in an alternating side by side array to regulate the bandwidth and standing wave ratio.

In still another embodiment, the antenna comprises a non-metallic conductive body portion with a metallic conductive coating to control the bandwith characteristics and standing wave ratio.

It is therefore an object of this invention to provide a new and improved antenna having a non-metallic conductive component.

It is another object of this invention to provide a new and improved antenna which provides extremely wide band widths while maintaining a low and tolerable standing wave ratio.

It is yet another object of this invention to provide a new and improved antenna which utilizes both metallic and non-metallic conductive portions to vary the bandwidth characteristics of the antenna.

It is still yet another object of this invention to provide a new and improved antenna which can be exposed to high temperatures without losing its transmission and reception characteristics.

In accordance with these and other objects which will be apparent hereinafter, the instant invention will now be described with particular reference to the accompanying drawings.

BRIEF DESCRIPTION OF THE DRAWINGS

FIG. 5 is a side elevational view of another embodiment of the present invention.

FIG. 5A is a graphical description of the band width V. SWR characteristics of the antenna embodied in FIG. 5.

FIG. 6 is a side elevational view of another embodiment of the present invention.

FIG. 6A is a graphical representation of the bandwidth V.SWR characteristics of the antenna embodied in FIG. 6.

FIG. 7 is a side partially in section view of another embodiment of the present invention.

FIG. 7A is a graphical representation of the bandwidth V. SWR characteristics of the antenna embodied in FIG. 7.

FIG. 8 is a expanded graphical representation of a portion of the graph shown in FIG. 7A.

DESCRIPTION OF THE PREFERRED EMBODIMENT

Figure 1:
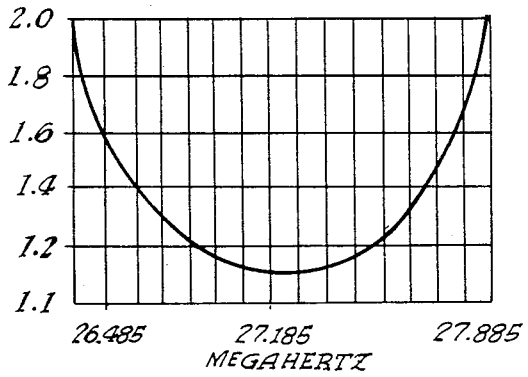
FIG. 1 is a representative graph of a typical antenna.

Referring now to FIG. 1, the graph of a typical antenna response is illustrated. As can be seen the antenna exhibits a standing wave ratio of approximately 1.1 to 1 at resonance and 2 to 1 at 26.485 megahertz and 27.885 megahertz (700 kilohertz below and above resonance). Therefore the bandwidth within the tolerable standing wave ratio limit is approximately 1500 kilohertz.

Figure 2:
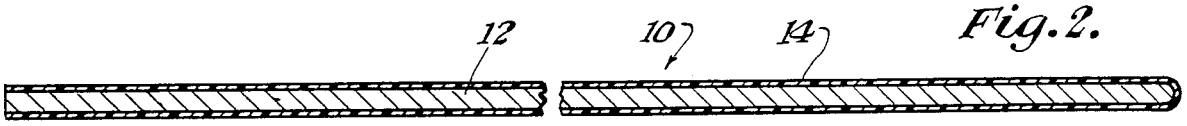
FIG. 2 is an elevational cross-sectional view of one embodiment of the present invention taken across the longitudinal axis of the antenna.

Referring now to FIG. 2, the antenna 10 is shown comprising a rod or body portion 12 having a non-conductive coating 14 such as strong plastic thereon. In this embodiment the rod or body portion 12 can be made of epoxy mixed with carbon and metal such as nickle, copper or zinc and other conductive metals well known in the art. The amount of carbon and metal added to the epoxy depends on the antenna characteristics desired. It should be noted that the length, diameter and width depends on the center frequency, bandwidth, and standing wave ratio required.

Figure 3:
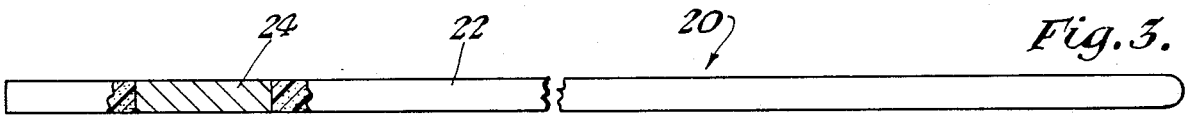
FIG. 3 is a cross-sectional view of another embodiment of the present invention taken across the longitudinal axis of the antenna.

Referring now to FIG. 3, another embodiment of the antenna is shown generally at 20.

Antenna 20 is formed from alternating metallic segments 24 and non-metallic segments, or body portions, 22. Metallic segments 24 may be of carbon, nickel, copper or other metallic conductors well known in the art. Non-metallic segment 22 may be graphite or carbon reinforced plastic or ceramic. The dimensions of the segments, and the rod as a whole, depends on the performance desired, e.g. electrical length, standing wave ratio, etc.

Please note that FIG. 3 shows, instead of conductive coatings, descrete segments of solid metal alternating with descrete segments of body-portion 22. The improved performance of the antenna is obtained regardless of whether coating segments or solid metal segments are used.

Figure 4:
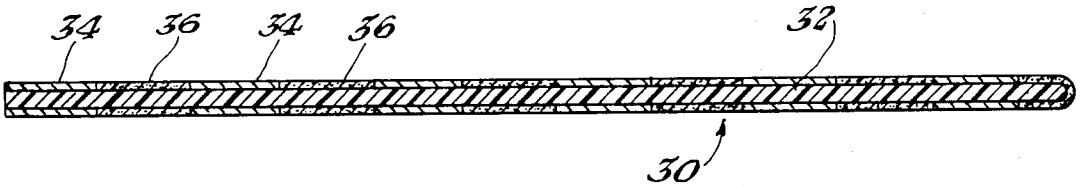
FIG. 4 is an elevational view of another embodiment of the present invention.

Referring now to FIG. 4, another embodiment of the antenna is shown generally at 30 and comprises an antenna rod or body portion 32 with a plurality of metallic conductive coatings 34 in alternating side by side relation with non-metallic conductive coating 36. In this embodiment, the rod or body portion 32 can be constructed of strong plastic or ceramic and is non-conductive. The coatings 34 may be constructed of nickle, zinc or other metallic conductors well known in the art which may be applied in various lengths and thicknesses depending on the required characteristics of the antenna. The coatings 36 are constructed of non-metallic conductive materials such as carbon or graphite which is also applied in various lengths and thicknesses depending on the required characteristics of the antenna. Again the length, diameter and width of the antenna 30 depends on the center frequency, bandwidth and standing wave ratio required.

Referring now to FIG. 5, another embodient of the antenna 50 is shown. In this embodiment, the antenna 50 is constructed of J-1/CF/50 carbon reinforced nylon made by Fiberfil Corporation. The length of the antenna is 14 inches, the thickness 0.135 inches and the width of the antenna 0.200 inches. The bandwidth and standing wave ratio characteristics of the antenna 50 are shown in FIG. 5A. As can be seen the center frequency is 160 megahertz with a very wide band width of 50 megahertz within the tolerable standing wave ratio of 2 to 1 or below. The DC resistance of the carbon reinforced nylon antenna 50 is approximately 19 ohms.

Referring now to FIG. 6, another embodiment of the antenna is shown generally at 60. Again the antenna was constructed from J-1/CF/50 carbon reinforced nylon manufactured by Fiberfil Corporation. In this embodiment the length of the antenna 60 is 14 inches, the width 0.700 inches and the thickness 0.135 inches. The center frequency is 170 megahertz and again a considerable bandwidth of 50 megahertz was measured. DC resistance of the antenna 60 was measured at 12 ohms. As can be seen in the graph the bandwidth of 60 megahertz was accomplished with a standing wave ratio of 2 to 1 or lower, well within the tolerable limits of communication.

Referring now to FIGS. 7, 7A and 8, the antenna 70 comprising a metal rod 72 which is 9½ inches long connected to a second portion 74 which was constructed of the J-1/CF/50 carbon reinforced nylon manufactured by Fiberfil Corporation which was 8½ inches long. As can be seen the bandwidth characteristics of the antenna 70 was such that the center frequency was 126 megahertz with a bandwidth of 20 megahertz within the tolerable standing wave ratio of 2 to 1 or below. One unusual characteristic of this antenna 70 is that a second tolerable frequency level beginning at 400 megahertz and extending to 500 megahertz before going off the graph, was recorded.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. An antenna comprising at least one solid, unitary, discrete metallic segment, and at least one similar solid, unitary, discrete, non-metallic, conductive segment, each segment having a longitudinal direction, and a longitudinally opposite pair of ends disposed along the longitudinal direction, wherein:

the antenna is formed by joining the at least one metallic segment and the at least one non-metallic segment into a single elongated member, the elongated member having a longitudinal direction coincident with the longitudinal direction of each discrete segment.

2. The antenna of claim 1, wherein the at least one metallic and non-metallic segments are a plurality of such segments, and the elongated member is formed by joining sequentially all segments of the metallic and non-metallic plurality longitudinal end to longitudinal end, each segment from the metallic plurality of segments alternating with a segment from the non-metallic plurality of segments.

3. The antenna of claim 2, wherein the metallic plurality of segments substantially comprises material selected from the group consisting of: nickel and copper; and the non-metallic plurality segments is selected from the group consisting of: graphite, carbon reinforced nylon, and graphite reinforced nylon.

4. The antenna of claim 1, wherein the at least one metallic segment substantially comprises material selected from the group consisting of: nickel and copper; and the non-metallic plurality of segments is selected from the group consisting of: graphite, carbon reinforced nylon, and graphite reinforced nylon.

* * * * *